US005959262A

United States Patent [19]

Menzel

[11] Patent Number: 5,959,262

[45] Date of Patent: Sep. 28, 1999

[54] EXHAUST-GAS MUFFLER

[75] Inventor: Johannes Menzel, Stuttgart, Germany

[73] Assignee: Andreas Stihl AG & Co., Walblingen, Germany

[21] Appl. No.: 09/182,477

[22] Filed: Oct. 30, 1998

[30] Foreign Application Priority Data

Oct. 30, 1997 [DE] Germany ..... 197 47 914

[51] Int. Cl.[6] ..... F01N 3/02

[52] U.S. Cl. ..... 181/231; 181/230

[58] Field of Search ..... 181/230, 231, 181/258, 255, 269, 272, 265, 240

[56] References Cited

U.S. PATENT DOCUMENTS 5,440,083 8/1995 Masuda ..... 181/240
5,722,237 3/1998 Iida et al. ..... 181/258
5,883,342 3/1999 Wolpert ..... 181/230

FOREIGN PATENT DOCUMENTS 2725899 12/1978 Germany .

*Primary Examiner*—Khanh Dang
*Attorney, Agent, or Firm*—Walter Ottesen

[57] ABSTRACT

The invention relates to an exhaust-gas muffler for a two-stroke engine in a portable handheld work apparatus such as a motor-driven chain saw. The muffler housing includes an outer shell and an inner shell and also includes an exhaust-gas inlet and an exhaust-gas outlet. A fire-protective screen is arranged in the exhaust-gas flow of the muffler. With the invention, a high service life of the fire-protective screen is achieved together with an easier exchangeability. This is achieved in that the fire-protective screen can be inserted from outside of the housing into the interior of the muffler. The screen covers the exhaust-gas inlet into an inlet chamber of the muffler. At this location, the temperature of the exhaust gas is high so that coking of the screen is very slight.

16 Claims, 2 Drawing Sheets

EXHAUST-GAS MUFFLER

BACKGROUND OF THE INVENTION

German patent publication 2,725,899 discloses an exhaust-gas muffler for an internal combustion engine, namely, a two-stroke engine which is mounted in a motor-driven chain saw. The housing of the exhaust-gas muffler comprises an outer shell and an inner shell which conjointly define the housing of the muffler. The housing has an exhaust-gas inlet and an exhaust-gas outlet as well as a fire-protective screen mounted in the exhaust-gas flow.

With time, coke forms on the fire-protective screen and the screen becomes gummy. It should therefore be mounted so that it can be cleaned or exchanged. In the known embodiment, the fire-protective screen is attached outside on the exhaust-gas outlet for the housing which cannot be disassembled. However, there the exhaust-gas temperature has dropped considerably so that unburned or partially burned fuel or lubricant can condensate and clog the fire-protective screen over time.

SUMMARY OF THE INVENTION

It is an object of the invention to provide an exhaust-gas muffler which is so configured that a fire-protective screen having a long service life can be easily exchanged.

The exhaust-gas muffler of the invention is for an internal combustion engine for driving a portable handheld work apparatus such as a motor-driven chain saw, a cutoff machine, a brushcutter or the like. The exhaust-gas muffler includes: an outer shell and an inner shell conjointly defining a housing having an interior; the inner shell defining an exhaust-gas inlet through which exhaust gas enters the housing; the housing defining an exhaust-gas outlet through which the exhaust gas exits from the housing whereby a flow of the exhaust gas passes through the muffler; the housing having an opening formed therein; the outer shell defining an inlet chamber communicating with the exhaust-gas inlet; and, a fire-protective screen insertable into the interior so as to cover the exhaust-gas inlet into the inlet chamber.

The fire-protective screen is mounted on the inside of the housing of the exhaust-gas muffler. For this reason, a formation of condensate is avoided because of the high exhaust-gas temperatures present there. Only a slight coking occurs. The fire-protective screen can be removed or built in from the outside of the muffler housing for control, cleaning or exchange.

The exhaust-gas muffler is advantageously configured so that it cannot be disassembled. The access to the interior takes place via a slit in the external housing wall. An exchange of the fire-protective screen is possible through this slit. In the built-in state, the fire-protective screen substantially closes the slit tightly. A possibly remaining residual gap has a size which does not exceed the mesh aperture of the fire-protective screen.

A high exhaust-gas temperature is present at the interior of the exhaust-gas inlet so that the fire-protective screen essentially assumes the temperature of the in-flowing exhaust gases.

An intermediate wall is advantageously arranged in the partition plane between the outer shell and the inner shell. This intermediate wall has an indentation in the region of the inlet opening and the indentation has an inclined plane which climbs toward the slit. The inclined plane advantageously serves as a support for the fire-protective screen which is most often configured as a mesh fabric or the like.

This ensures a reliable guide and exact insert position for the fire-protective screen which effect can be increased by the arrangement of a guide coacting with the plane.

The guide advantageously includes a support for the fire-protective screen which extends across the inlet opening and which lies against the fire-protective screen without play. In this way, the fire-protective screen is mechanically protected against the pulsating exhaust-gas pressure. An exhaust-gas shower is achieved if the support is configured as a perforated sheet metal plate covering the inlet opening. This can be advantageous for improved noise attenuation. The inlet opening can be connected via an exhaust-gas stub to the exhaust-gas input whereby a type of muffler antechamber is formed.

Preferably, the exhaust-gas outlet is arranged in the region of the slit so that leakage exhaust gas, which possibly flows out of the slit, can form a unitary exhaust gas flow with the exiting exhaust gas and this can be conducted away in a targeted manner.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
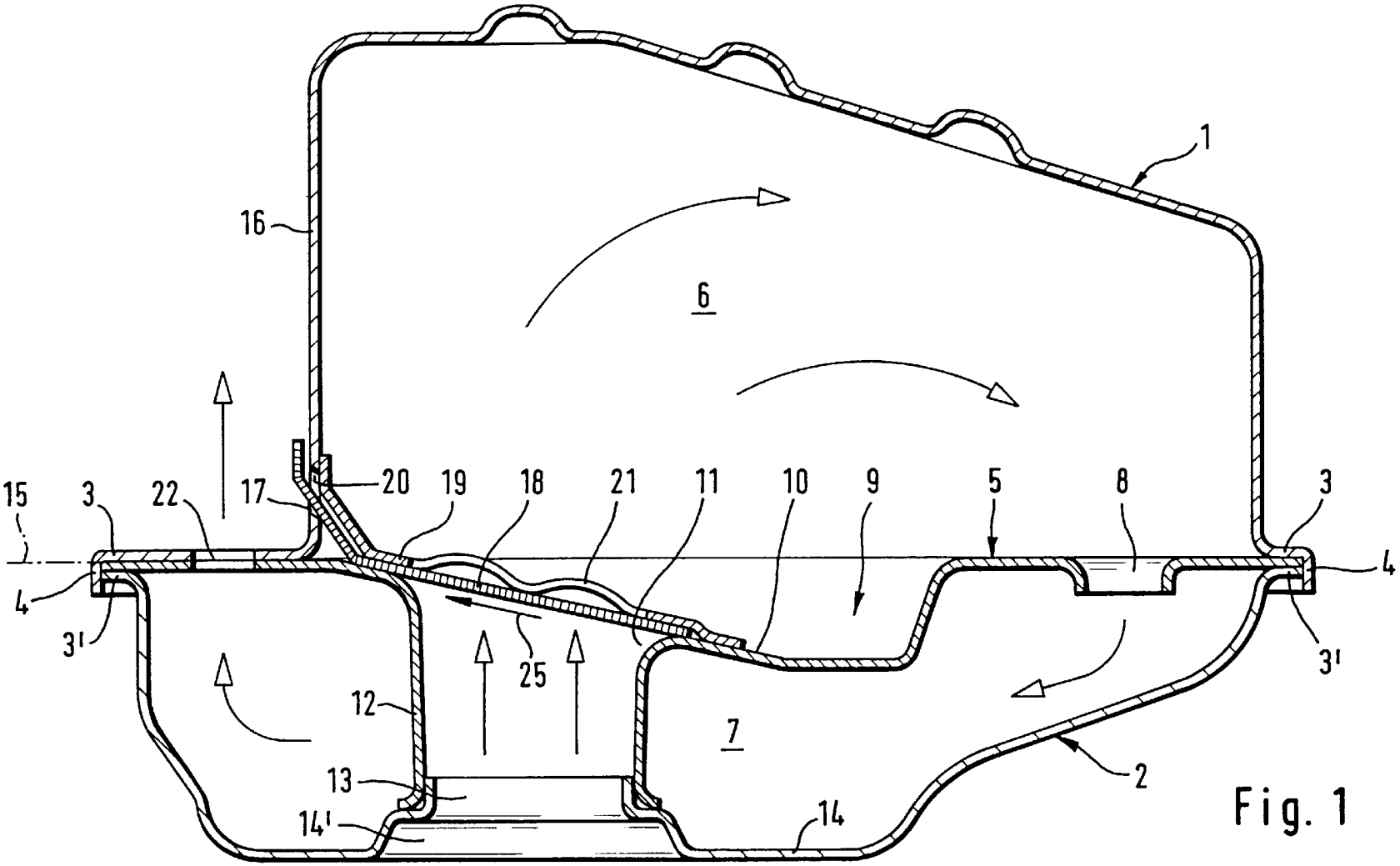
FIG. 1 is a side elevation view, in section, of an exhaust-gas muffler having an interior fire-protective screen accessible from the outside; and, FIG. 2 is an exploded view of the exhaust-gas muffler of FIG. 1.
Figure 2:
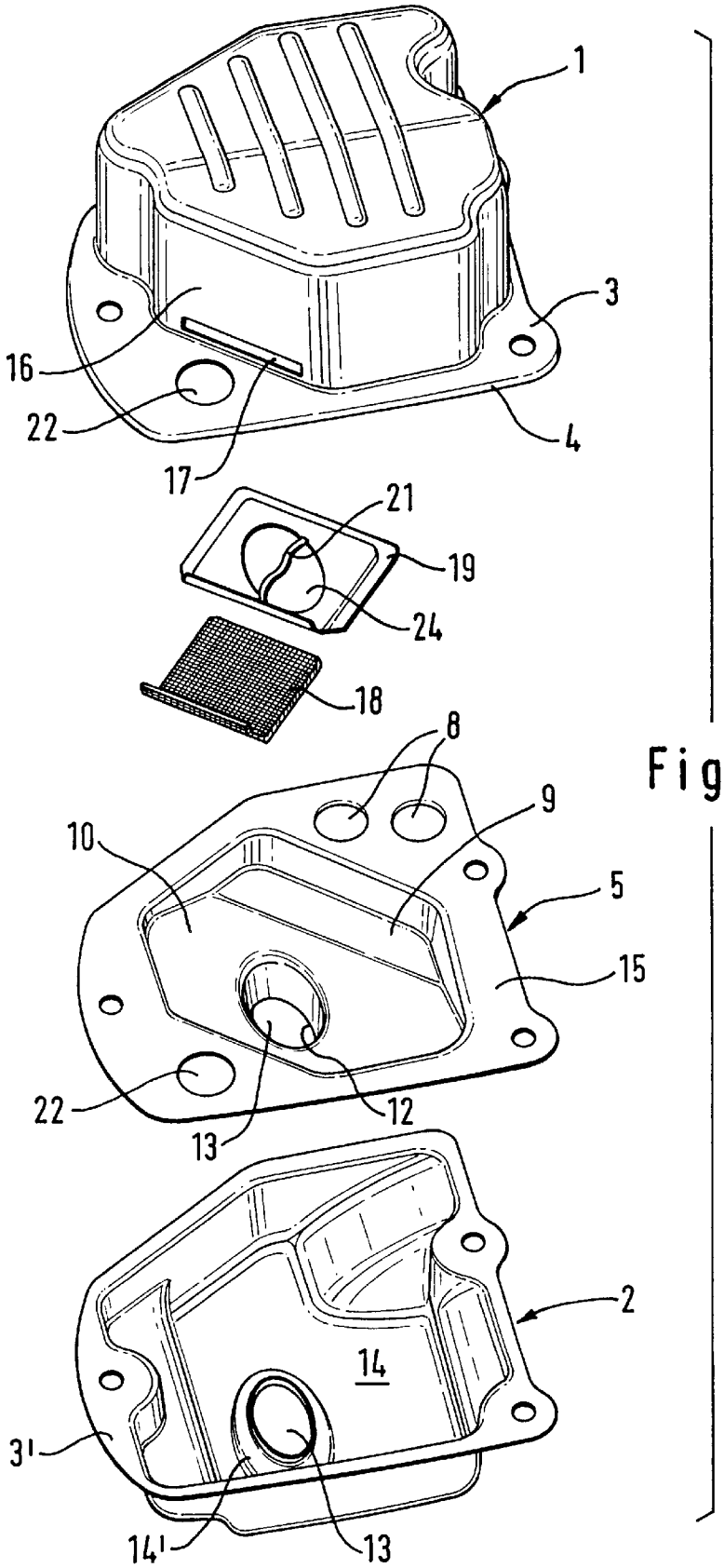

The exhaust-gas muffler shown in FIGS. 1 and 2 is for a two-stroke engine, especially for a two-stroke engine in a motor-driven chain saw, brushcutter, cutoff machine or similar portable handheld work apparatus. The muffler housing comprises a deep-drawn outer shell 1 and a correspondingly made inner shell 2. The inner and outer shells are both provided with planar collars (3, 3'). The outer shell additionally has a peripherally extending edge 4 which extends into the collar 3. The planar collar 3' of the inner shell 2 lies in the peripherally extending edge 4 of the outer shell 1. The edge 4 engages over the collar 3' of the inner shell 2.

An intermediate wall 5 is clamped between the housing shells (1, 2) in the partition plane 15 thereof. The intermediate wall 5 lies against the collars (3, 3') and is joined together with the shells (1, 2) to form an especially gas-tight exhaust-gas muffler. The joining can, for example, be by bending over the peripherally extending edge 4 or by soldering the parts together.

The muffler housing is partitioned by the intermediate wall 5 into a larger inlet chamber 6 and a smaller outlet chamber 7. The two chambers are flow connected to each other by connecting openings 8 in the intermediate wall 5. The number, position and size of the connecting openings 8 are suitably matched to a desired noise attenuation.

The intermediate wall 5 has an indentation 9 which projects into the inner shell 2. The indentation 9 has an inclined planar portion 10 in which an inlet opening 11 is provided. The inlet opening 11 is connected via an inner exhaust-gas stub 12 to an exhaust-gas inlet 13 in a planar base 14 of the inner shell 2. The inner exhaust-gas stub 12 is advantageously configured as one piece with the deep-drawn intermediate wall 5. The exhaust-gas inlet 13 includes a widening 14' to the outlet stub of the internal combustion engine.

A slit 17 is configured in a side wall 16 of the outer shell 1 in the region of the partition plane 15. The slit 17 lies parallel to the partition plane 15 at a slight spacing therefrom and is directed toward the inlet opening 11. A fire-protective screen 18 can be pushed in through the slit 17. The fire-protective screen comes to rest on the inclined plane 10 which climbs in elevation to the slit 17 thereby facilitating the insertion and exchange of the screen. The inlet opening 11 is formed in the planar portion 10. The exhaust-gas flow has a high temperature at this location so that a coking of the fire-protective screen 18 can hardly occur.

A guide 19 for the fire-protective screen 18 is attached to the inclined planar portion 10. The guide 19 and the planar portion 10 conjointly define an insert within which the inlet opening 11 lies. The guide 19 extends from an upper edge 20 of the slit 17 up to the inclined plane 10 and further parallel as well as at a spacing of at least the thickness of the screen 18 to the planar portion 10.

The guide 19 suitably includes a support 21 for the fire-protective screen 18 which extends over the inlet opening 11 transversely in the form of a bracket and preferably lies without play against the fire-protective screen 18. In this way, the load on the screen 18 caused by the pulsating exhaust-gas flow is mechanically taken up.

The support 21 can be advantageously configured as a sheet metal plate which can have a plurality of holes in the manner of a shower. This serves, at the same time, as means for noise attenuation and extends the inner exhaust-gas stub 12 to a muffler antechamber.

The fire-protective screen 18 is fixed externally on the outer shell 1 in the region of the side wall 16 via screws or is clipped thereto so that it cannot separate therefrom.

The slit 17 and the fire-protective screen 18 are so matched with respect to their dimensions that the slit 17 is substantially sealed off when the fire-protective screen 18 is inserted. A remaining residual gap does not exceed the mesh aperture of the fire-protective screen.

The side wall 16 of the outer shell 1 is offset relative to the inner shell 2. In this way, space is provided for an exhaust-gas outlet 22 in the part of the outer shell 1 lying forward of the side wall 16 and in the partition plane 15. An exhaust-gas output pipe can be provided also in lieu of a simple exhaust-gas outlet 22. In each case, the exhaust gas of the exhaust-gas outlet 22 mixes with leakage gases, which possibly exit from the slit 17, to form a unitary exhaust-gas flow.

The engine exhaust gas of the two-stroke engine passes through the exhaust-gas inlet 13 into the inner exhaust-gas stub 12 and flows through the fire-protective screen 18. The high exhaust-gas temperature, which is present at this location, prevents a formation of condensate in the mesh of the fire-protective screen so that this screen remains substantially clean. The fire-protective screen 18 can be pulled out for control or exchange in the direction of arrow 25 at any time via the slit 17 without additional work on the muffler being necessary. If required, the screen can also be exchanged.

The exhaust gas flows through the fire-protective screen 18 and the pass-through opening 24, which is provided in the support 21, into the inlet chamber 6 and then via the connecting openings 8 into the outlet chamber 7. From there, the exhaust gas exits to the ambient via the exhaust-gas opening 22.

It is understood that the foregoing description is that of the preferred embodiments of the invention and that various changes and modifications may be made thereto without departing from the spirit and scope of the invention as defined in the appended claims.

What is claimed is:

1. An exhaust-gas muffler for an internal combustion engine for driving a portable handheld work apparatus such as a motor-driven chain saw, a cutoff machine, a brushcutter or the like, the exhaust-gas muffler comprising:

an outer shell and an inner shell conjointly defining a housing having an interior;

said inner shell defining an exhaust-gas inlet through which exhaust gas enters said housing;

said housing defining an exhaust-gas outlet through which said exhaust gas exits from said housing whereby a flow of said exhaust gas passes through said muffler;

said housing having an opening formed therein;

said outer shell defining an inlet chamber communicating with said exhaust-gas inlet; and, a fire-protective screen insertable into said interior so as to cover said exhaust-gas inlet into said inlet chamber.

2. The exhaust-gas muffler of claim 1, one of said shells having a slit formed therein for facilitating insertion of said fire-protective screen into said housing; and, said slit being dimensioned so as to be essentially sealed when said fire-protective screen is inserted.

3. The exhaust-gas muffler of claim 2, said outer and inner shells conjointly defining a partition plane; said exhaust-gas muffler further comprising an intermediate wall having an inlet opening for passing the exhaust gas from said exhaust-gas inlet into said inlet chamber; said outer shell having a side wall; and, said slit being formed in said side wall in the region of said partition plane and being directed toward said inlet opening.

4. The exhaust-gas muffler of claim 3, said intermediate wall having an indentation in the region of said inlet opening; and, said indentation defining an inclined planar portion of said intermediate wall extending upwardly toward said slit.

5. The exhaust-gas muffler of claim 4, said inclined planar portion defining a support for said fire-protective screen.

6. The exhaust-gas muffler of claim 5, further comprising a guide attached to said inclined planar portion; said guide and said inclined planar portion conjointly defining a shoe for accommodating said fire-protective screen therein; and, said shoe covering said inlet opening.

7. The exhaust-gas muffler of claim 6, said slit having an upper edge and said guide extending from said upper edge to and parallel to said inclined planar portion at a spacing with respect thereto corresponding to the thickness of said fire-protective screen.

8. The exhaust-gas muffler of claim 7, said guide having a support for said fire-protective screen; said guide extending over said inlet opening; and, said guide being in contact engagement with said fire-protective screen.

9. The exhaust-gas muffler of claim 8, said guide being configured as a sheet-metal plate having at least one pass-through opening.

10. The exhaust-gas muffler of claim 1, further comprising means for fastening said fire-protective screen to the external wall surface of said outer shell.

11. The exhaust-gas muffler of claim 3, further comprising an inner exhaust-gas stub interconnecting said exhaust-gas inlet and said inlet opening in said intermediate wall.

12. The exhaust-gas muffler of claim 11, said inner exhaust-gas sub and said intermediate wall being configured as a single piece.

13. The exhaust-gas muffler of claim 2, said exhaust-gas outlet being disposed in the region of said slit.

14. The exhaust-gas muffler of claim 6, said outer shell, said guide, said intermediate wall and said inner shell all being formed as deep-drawn parts and being inseparably joined to each other in one work step.

15. The exhaust-gas muffler of claim 14, said deep-drawn parts being joined to each other by brazing or soldering.

16. The exhaust-gas muffler of claim 14, said deep-drawn parts being joined by bending over one part onto another.

* * * * *